US011745376B2

(12) United States Patent
Groat et al.

(10) Patent No.: US 11,745,376 B2
(45) Date of Patent: Sep. 5, 2023

(54) TOOL ASSEMBLY INCLUDING HEATED CUTTING TOOL FOR USE IN CUTTING FABRIC

(71) Applicant: SAFE LIFE DEFENSE, LLC, Las Vegas, NV (US)

(72) Inventors: Nick Groat, Las Vegas, NV (US); Brian Jones, Las Vegas, NV (US)

(73) Assignee: Safe Life Defense, L.L.C., Las Vegas, NV (US)

( * ) Notice: Subject to any disclaimer, the term of this patent is extended or adjusted under 35 U.S.C. 154(b) by 0 days.

(21) Appl. No.: 17/152,372

(22) Filed: Jan. 19, 2021

(65) Prior Publication Data

US 2022/0227018 A1 Jul. 21, 2022

(51) Int. Cl.
*B26D 7/10* (2006.01)
*B26D 1/00* (2006.01)

(52) U.S. Cl.
CPC ..... *B26D 7/10* (2013.01); *B26D 1/0006* (2013.01)

(58) Field of Classification Search
CPC ..... B65B 61/10; B26D 7/10; B26D 1/095; D06H 7/2221; D06H 7/223; D06H 7/221; D06H 7/02
See application file for complete search history.

(56) References Cited

U.S. PATENT DOCUMENTS 2,623,586 A * 12/1952 Volpi ..... D06H 7/04 83/171
3,685,251 A * 8/1972 Mahaffy ..... B29C 51/445 53/329.5
4,000,029 A * 12/1976 Michaels ..... B29C 65/18 156/510
4,017,012 A * 4/1977 Brock ..... B26D 1/04 83/171
4,353,196 A * 10/1982 Beer ..... B29C 66/81457 53/51
4,480,174 A * 10/1984 Hummel ..... H05B 3/44 219/205
4,626,665 A * 12/1986 Fort, III ..... C08F 8/44 338/238
4,975,140 A * 12/1990 Kang ..... B29C 65/7441 112/470.34
5,015,223 A * 5/1991 Boeckmann ..... B29C 66/723 156/581
6,422,986 B1 * 7/2002 Claybaker ..... B29C 65/26 493/197
6,425,848 B2 * 7/2002 Bell ..... B29C 66/80 493/470

(Continued)

*Primary Examiner* — Ghassem Alie
*Assistant Examiner* — Samuel A Davies
(74) *Attorney, Agent, or Firm* — Howard & Howard Attorneys PLLC

(57) ABSTRACT

A cutting tool for use with a heated tool assembly is described herein. The cutting tool includes a support body and a plurality of cutting blades extending outwardly from an outer surface of the support body. The plurality of cutting blades includes a primary cutting blade and a pair of secondary cutting blades extending obliquely from the primary cutting blade. At least one heating element chamber is defined within the support body and is configured to receive a heating cartridge therein to facilitate transferring thermal energy from the heating cartridge to the cutting tool for use in heating the plurality of cutting blades.

20 Claims, 8 Drawing Sheets

(56) References Cited

U.S. PATENT DOCUMENTS

| | | | | |
|---|---|---|---|---|
| 7,219,483 | B2 * | 5/2007 | Adair, Jr. | B29C 66/80 53/370.7 |
| 2003/0046905 | A1 * | 3/2003 | Kaechele | B29C 65/18 53/568 |
| 2006/0060041 | A1 * | 3/2006 | Nalle, III | B29C 66/1122 83/13 |
| 2011/0041457 | A1 * | 2/2011 | Montano | B29C 66/4312 53/373.7 |

* cited by examiner

TOOL ASSEMBLY INCLUDING HEATED CUTTING TOOL FOR USE IN CUTTING FABRIC

TECHNICAL FIELD

This invention relates generally to machine tool assemblies, and more specifically, to a heated cutting tool for use in cutting fabric.

BACKGROUND OF THE INVENTION

At least some known fabric cutting machines includes rotary blades that are used to cut sheets of fabric into desired shapes. The sheets are held in place on a cutting platform as a mechanical arm moves the rotating blade across the sheet of fabric to allow the rotary blade to cut the sheet of fabric to the desired shape. Over time, the edge of the rotary blade becomes worn, which causes an uneven cutting of the fabric, which results in frayed edges that require additional work to repair.

The present invention addresses one or more of the aforementioned challenges.

SUMMARY OF THE INVENTION

In different embodiments of the present invention, a heated tool assembly for use in a cutting press machine, are provided.

In one embodiment of the present invention, a cutting tool for use with a tool assembly is provided. The cutting tool includes a support body and a plurality of cutting blades extending outwardly from an outer surface of the support body. The plurality of cutting blades includes a primary cutting blade and a pair of secondary cutting blades extending obliquely from the primary cutting blade. At least one heating element chamber is defined within the support body and is configured to receive a heating cartridge therein to facilitate transferring thermal energy from the heating cartridge to the cutting tool for use in heating the plurality of cutting blades.

In another embodiment of the present invention, a tool assembly is provided. The tool assembly includes a cutting tool and a heating assembly. The cutting tool includes a support body and a plurality of cutting blades extending outwardly from an outer surface of the support body. The plurality of cutting blades includes a primary cutting blade and a pair of secondary cutting blades extending obliquely from the primary cutting blade. The heating assembly is coupled to the cutting tool for transferring thermal energy to the cutting tool for use in heating the plurality of cutting blades. The heating assembly includes at least one heating cartridge positioned within a corresponding heating element chamber defined within the support body.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION

Figure 1:
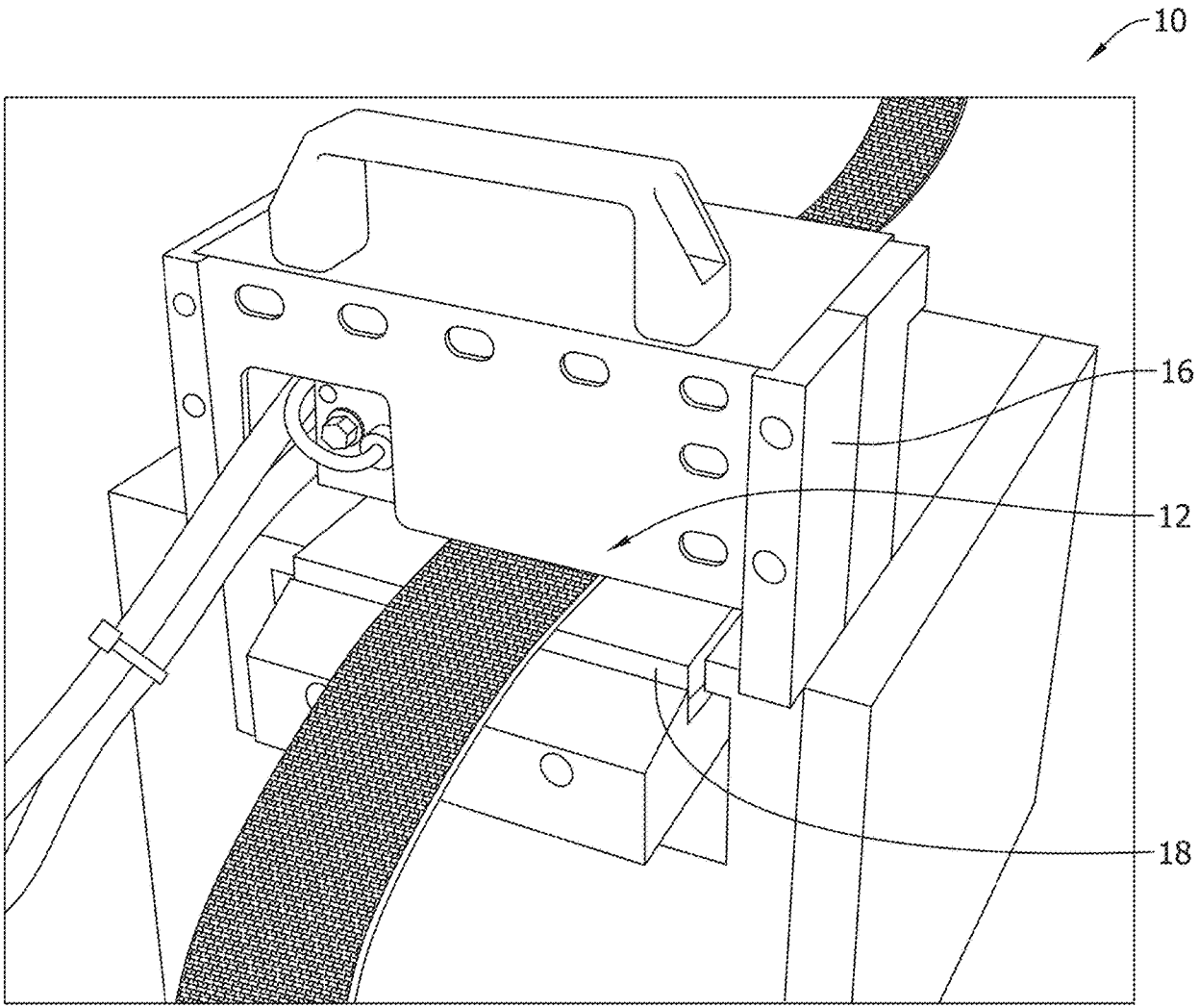
FIG. 1 is a perspective view of a fabric cutting machine for use in cutting fabric including a heated tool assembly, according to an embodiment of the present invention.
Figure 2:
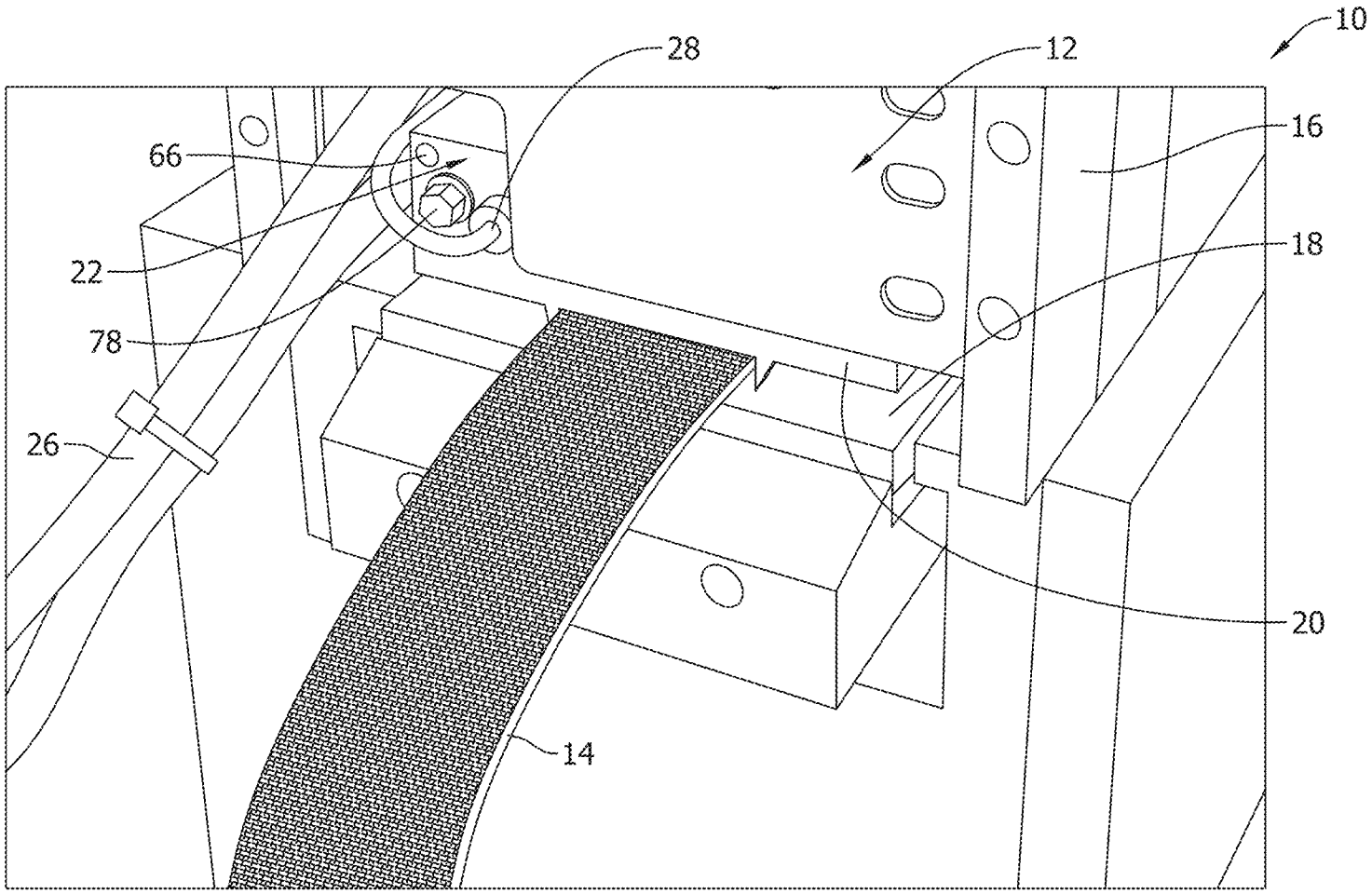
FIG. 2 is a perspective view of the heated tool assembly shown in FIG. 1 including a cutting tool, according to an embodiment of the present invention.
Figure 3:
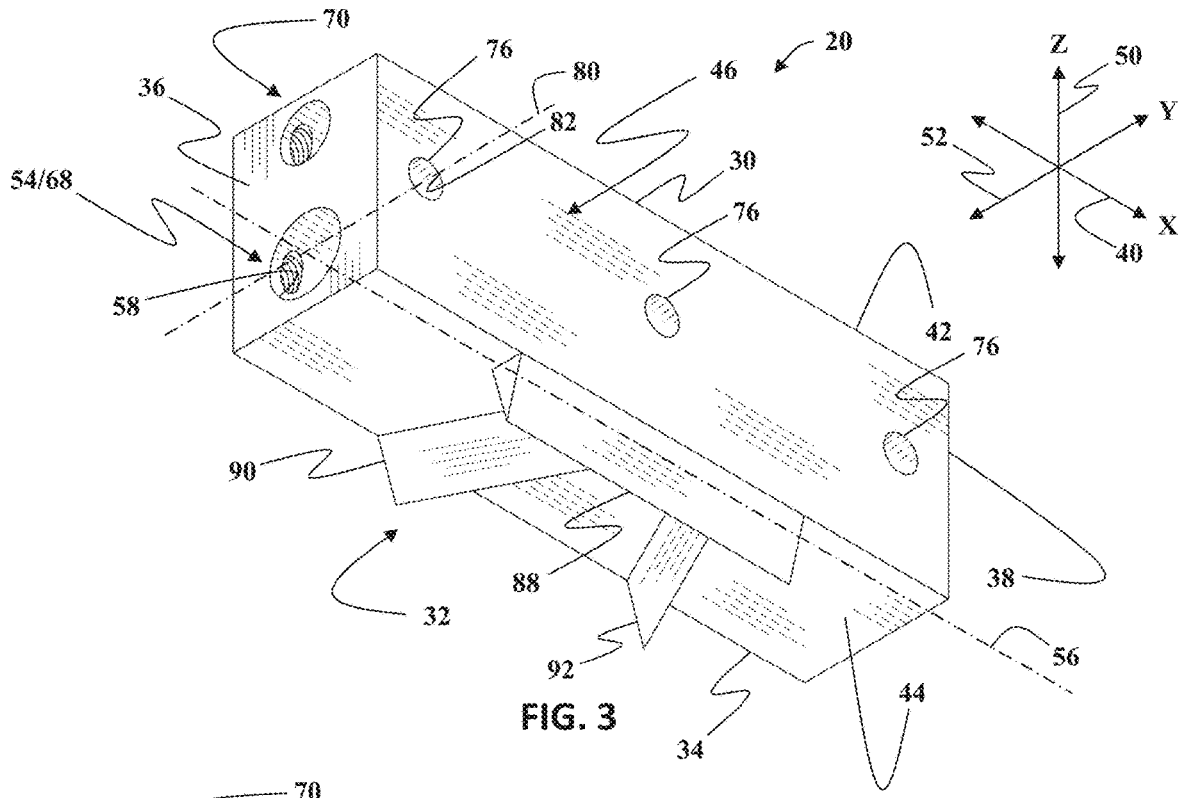
FIG. 3 is perspective view of the cutting tool showing front and bottom sidewalls of a support body and a plurality of cutting blades.
Figure 4:
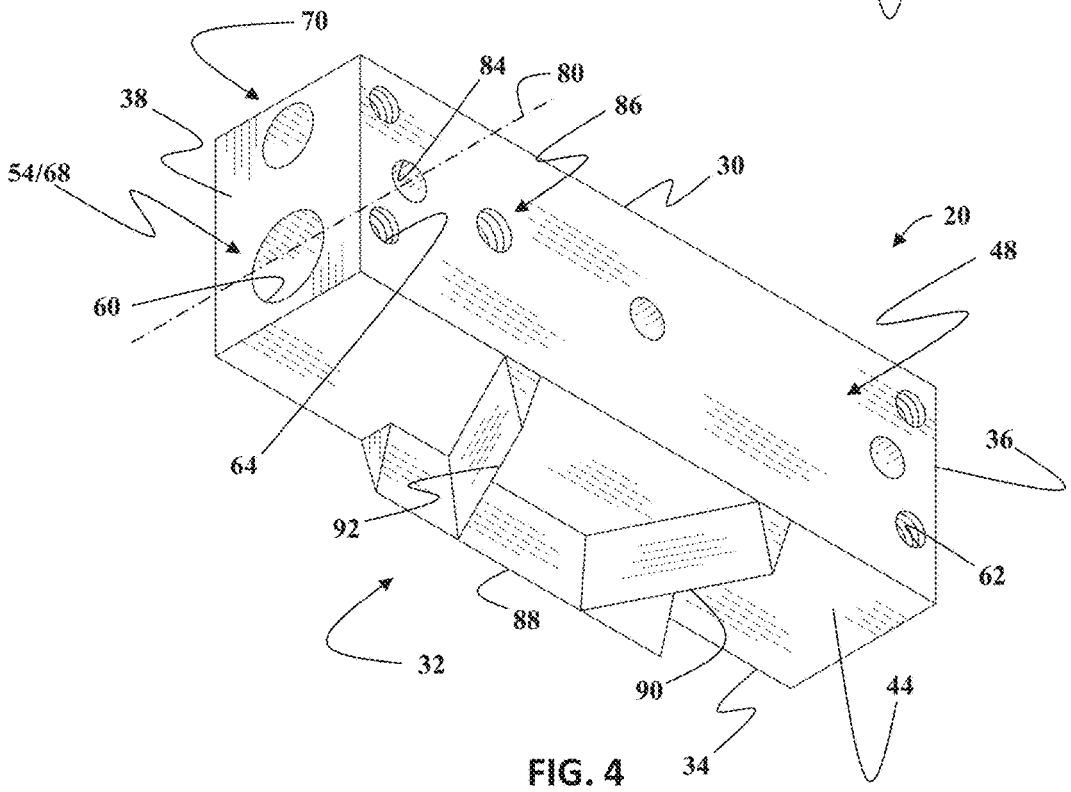
FIG. 4 is another perspective view of the cutting tool showing rear and bottom sidewalls of the support body and the plurality of cutting blades.
Figure 5:
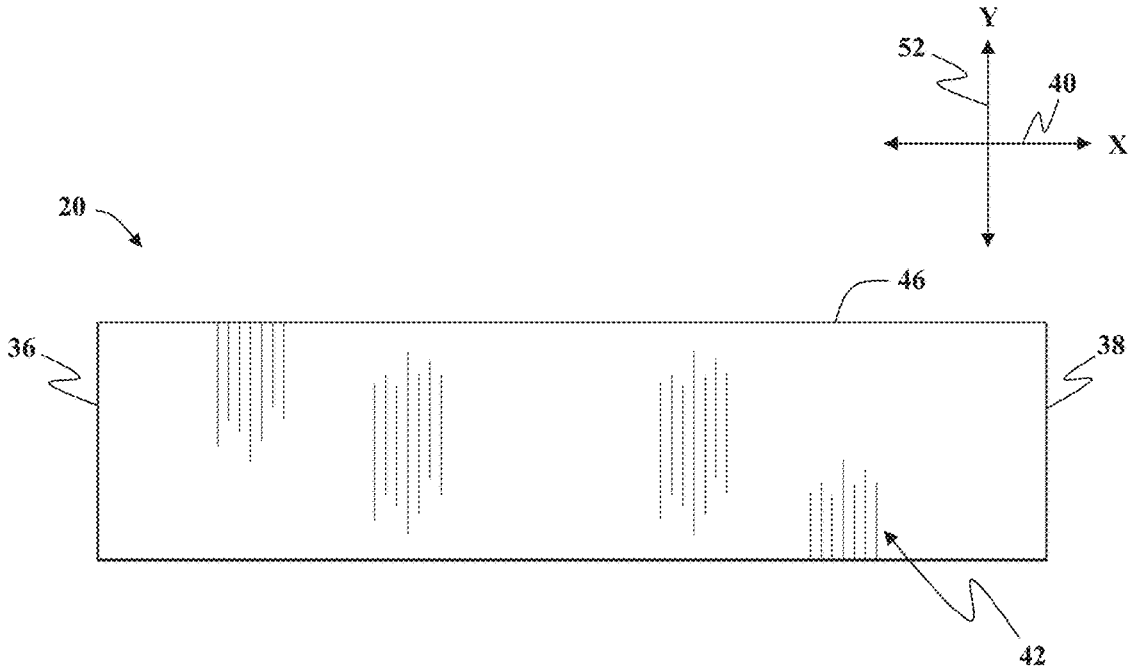
FIG. 5 is a top view of the cutting tool.
Figure 6:
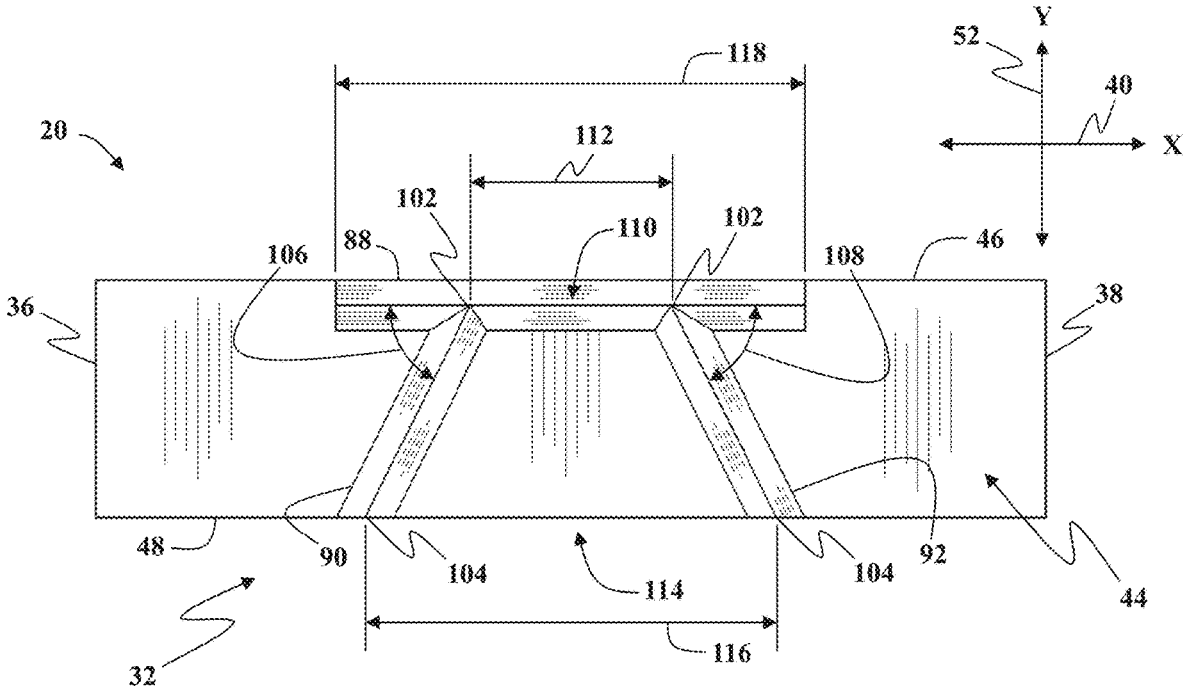
FIG. 6 is a bottom view of the cutting tool.
Figure 7:
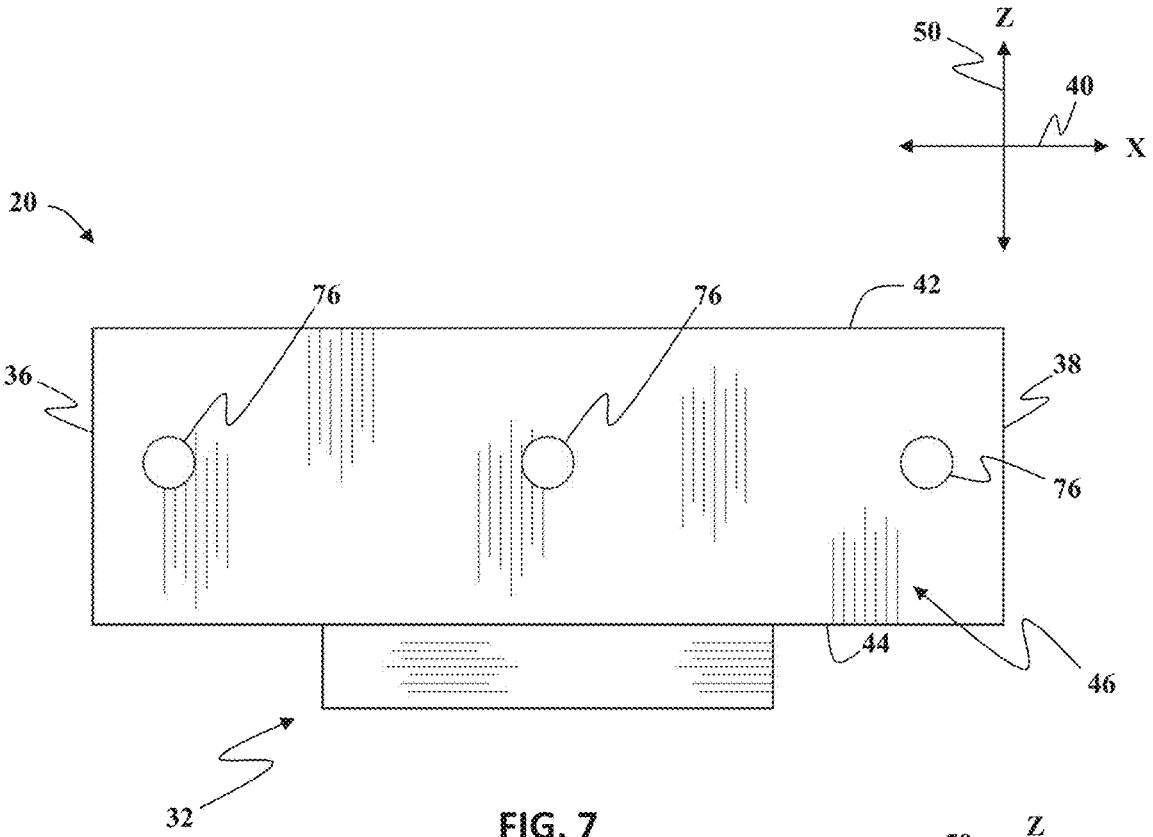
FIG. 7 is a front view of the cutting tool.
Figure 8:
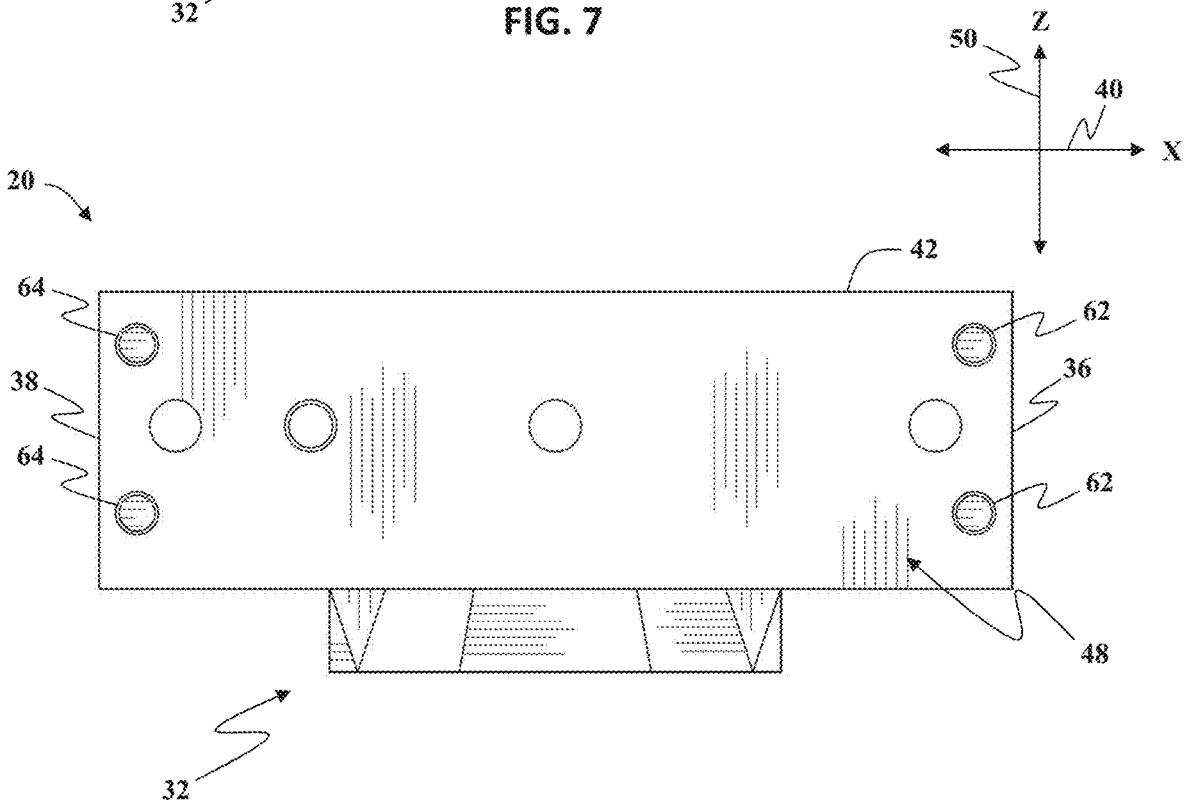
FIG. 8 is a rear view of the cutting tool.
Figure 9:
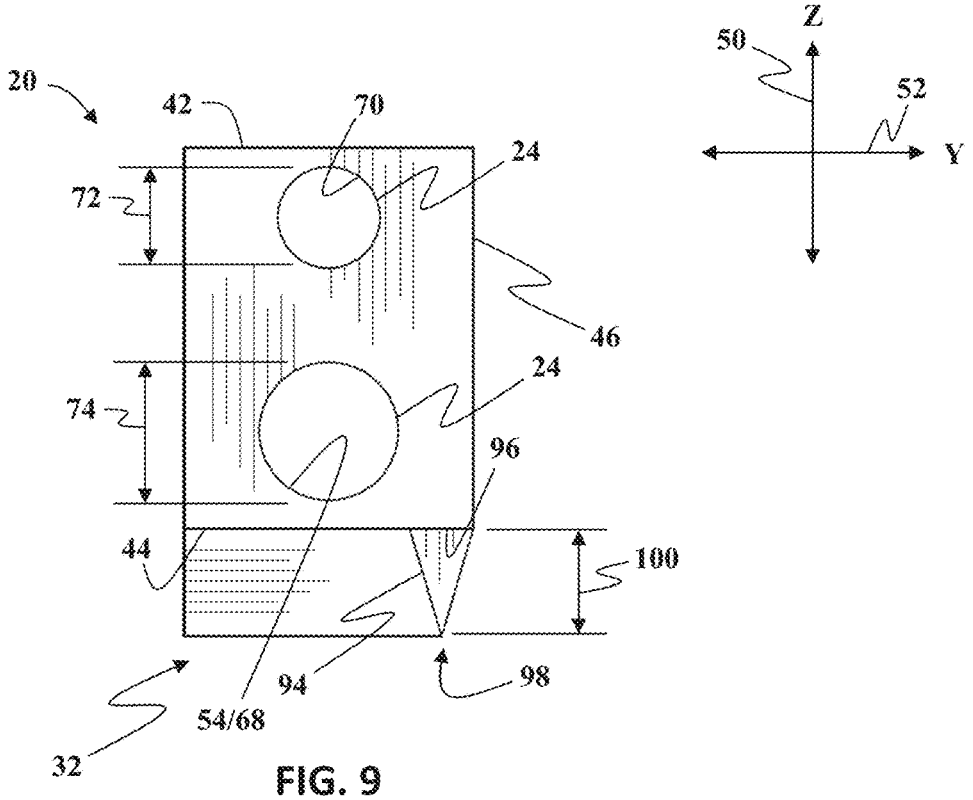
FIG. 9 is a left-side view of the cutting tool.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In general, the present invention describes a heated tool assembly for use with an automatic cutting machine. The heated tool assembly includes a heating cartridge that is inserted into a cutting tool to facilitate heating and maintaining a temperature of the blades of the cutting tool. The cutting tool is designed to function as a highly-efficient heated knife blade made to cut fabric material. The blade cuts a proprietary shape and a straight cut simultaneously. The more heat provided to the blade, the more perfectly repeatable the cuts will be. The tip of the blade loses small amounts of heat during each cut when energy from the blade is drawn away by the material being cut. The heating cartridge helps minimize that effect by providing heat to bring the blade back up to ideal operating temperature quickly and provides an optimal balance between energy consumption and repeatable cut performance. As a roll of fabric is passed under the heated tool assembly, the cutting machine presses the cutting tool into the fabric to cut the fabric into desired shapes. By using the heated cutting tool, the cutting machine produces a more consistent cut in the fabric than other known fabric cutting machines.

Referring to FIGS. 1-10, in the illustrated embodiment, the present invention includes an automatic cutting machine 10 that includes a heated tool assembly 12 for use in cutting woven fabric material 14 into desired shapes. The cutting machine 10 includes a machine press 16 positioned over a base platform 18. The heated tool assembly 12 is mounted to the machine press 16 and is oriented to contact the base platform 18 when moved by the machine press 16. During operation, a woven fabric material is positioned on the base platform 18 underneath the heated tool assembly 12. The machine press 16 operates to move the heated tool assembly 12 towards the base platform 18 to contact the woven fabric material 14. As the heated tool assembly 12 is pressed towards the woven fabric material 14, the blades of the heated tool assembly 12 cut the woven fabric material 14 into a desired shape.

In the illustrated embodiment, the heated tool assembly 12 includes a cutting tool 20 and a heating assembly 22 that is coupled to the cutting tool 20 for transferring thermal energy to the cutting tool 20. The heating assembly 22 includes at least one heating cartridge 24 (shown in FIG. 9) that is inserted into the cutting tool 20. A heating element 26 (shown in FIG. 2) is coupled to the heating cartridge 24 and is configured to transfer thermal energy to the heating cartridge 24 to facilitate heating the cutting tool 20. The heating cartridge 24 may include for example, a heating rod formed of Incoloy 800. However, one skilled in the art would understand that the heating cartridge 24 may be formed from other suitable materials. A thermocouple 28 (shown in FIG. 2) is mounted to the cutting tool 20 for use in measuring a temperature of the cutting tool 20 to facilitate regulating the heating assembly 22 to maintain the cutting tool 20 at a desired temperature.

Referring to FIGS. 3-10, the cutting tool 20 includes a support body 30 and a plurality of cutting blades 32 that extend outwardly from an outer surface of the support body 30. In the illustrated embodiment, the support body 30 and the plurality of cutting blades 32 are formed as a single unitary piece. In other embodiments, one or more cutting blades 32 may be coupled to the support body 30 via a weld, or similar method.

The support body 30 includes a substantially rectangular cross-sectional shape including a plurality of sidewalls 34 extending between a first endwall 36 and an opposite second endwall 38 along a first axis 40 (e.g., an X-axis). The plurality of sidewalls 34 includes a top sidewall 42, a bottom sidewall 44, a front sidewall 46, and a rear sidewall 48. The bottom sidewall 44 is spaced a distance from the top sidewall 42 along a second axis 50 (e.g., a Z-axis) that is perpendicular to the first axis 40. The rear sidewall 48 is spaced a distance from the front sidewall 46 along a third axis 52 (a Y-axis) that is perpendicular to the first axis 40 and the second axis 50. At least one heating element chamber 54 is defined within the support body 30 and is sized and shaped to receive a heating cartridge 24 therein to facilitate transferring thermal energy from the heating cartridge 24 to the cutting tool 20 for use in heating the plurality of cutting blades 32.

Referring to FIGS. 3, 4, 9, and 10, the heating element chamber 54 is orientated substantially parallel to the first axis 40 and includes an inner surface that defines a substantially cylindrical cavity that extends along a centerline axis 56 between a first open end 58 defined at the first endwall 36 and an opposite second open end 60 defined at the second endwall 38. In some embodiments, the heating element chamber 54 is spaced an equal distance between the front sidewall 46 and the rear sidewall 48. In other embodiments, the heating element chamber 54 may be positioned closer to the front sidewall 46 or closer to the rear sidewall 48. In the illustrated embodiment, the heating element chamber 54 is spaced a distance from the top sidewall 42 such that the heating element chamber 54 is positioned nearer to the bottom sidewall 44 than the top sidewall 42. In other embodiments, the heating element chamber 54 may be equally spaced between the bottom sidewall 44 than the top sidewall 42.

The support body 30 also includes a pair of set screw openings 62, 64 that are defined along the rear sidewall 48. Each set screw opening 62, 64 is sized and shaped to receive a corresponding set screw 66 (shown in FIG. 2) therein to facilitate coupling the heating cartridge 24 to the support body 30. Each set screw opening 62, 64 includes a cylindrical inner surface extending between the rear sidewall 48 and the heating element chamber 54 and is sized and shaped to receive a set screw 66 therein. The cylindrical inner surface includes a threaded portion to facilitate the set screw 66 contacting the heating cartridge 24 to facilitate coupling the heating cartridge 24 to the support body 30 via friction fit. The pair of set screw openings 62, 64 includes a first set screw opening 62 orientated adjacent to the first endwall 36 and a second set screw opening 64 orientated adjacent to the second endwall 38.

Figure 10:
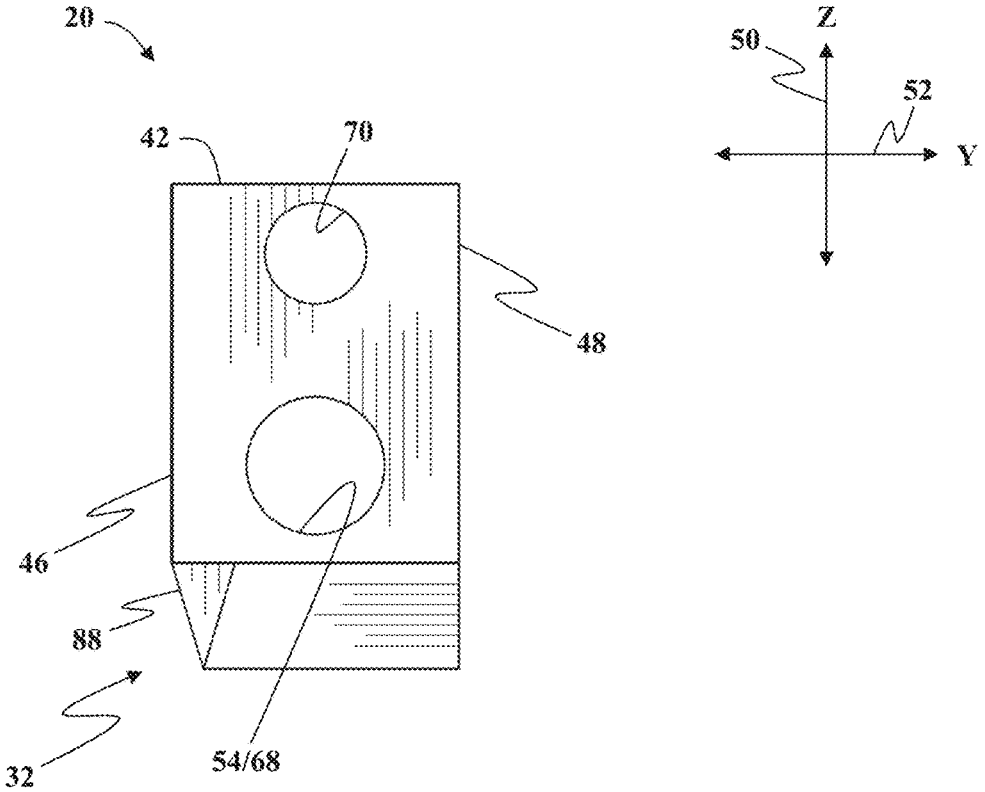
FIG. 10 is a right-side view of the cutting tool.

In some embodiments, the support body 30 includes a first heating element chamber 68 that is sized and shaped to receive a first heating cartridge 24 therein and a second heating element chamber 70 that is sized and shaped to receive a second heating cartridge 24 therein. The second heating element chamber 70 is orientated between the first heating element chamber 68 and the top sidewall 42. In the illustrated embodiment, the second heating element chamber 70 includes a diameter 72 that is smaller than a diameter 74 of the first heating element chamber 68. In some embodiments, the diameter 72 of the second heating element chamber 70 may be greater than, or equal to, the diameter of the first heating element chamber 68. In the illustrated embodiment, the first and second heating element chambers 68, 70 are each spaced an equal distance between the front sidewall 46 and the rear sidewall 48. In other embodiments, the first heating element chamber and/or the second heating element chamber 70 may be positioned closer to the front sidewall 46 or closer to the rear sidewall 48. The first and second heating element chambers 68, 70 may be aligned along the second axis 50, as shown in FIG. 10, or the first and second heating element chambers 68, 70 may be in an off-set relationship from the second axis 50.

In the illustrated embodiment, the support body 30 includes a plurality of mounting chambers 76 spaced along the first axis 40. Each mounting chamber 76 is sized and shaped to receive a mounting fastener 78 (shown in FIG. 2) therethrough to facilitate coupling the support body 30 to the machine press 16. Each mounting chamber 76 includes an inner surface that defines a substantially cylindrical cavity extending along a centerline axis 80 between a first open end 82 defined at the front sidewall 46 and an opposite second open end 84 defined at the rear sidewall 48. In some embodiments, each mounting chamber 76 spaced an equal distance apart along the first axis 40, and is spaced an equal distance between the top sidewall 42 and the bottom sidewall 44. The mounting chambers 76 may also be positioned between the first heating element chamber 68 and the second heating element chamber 70 along the second axis 50.

At least one thermocouple opening 86 is defined along an outer surface of the rear sidewall 48. The thermocouple opening 86 includes a threaded inner surface that is sized and shaped to receive the thermocouple 28 therein to facilitate mounting the thermocouple 28 to the support body 30. In the illustrated embodiment, the thermocouple opening 86 is orientated closer to the second endwall 38 than the first endwall 36 and extends between the first heating element chamber 68 and the second heating element chamber 70.

Referring to FIGS. 3, 4, 6, 9, and 10, in the illustrated embodiment, the plurality of cutting blades 32 extend outwardly from the bottom sidewall 44 and include a primary cutting blade 88 and a pair of secondary cutting blades 90, 92. The primary cutting blade 88 is positioned adjacent to the front sidewall 46 and is oriented substantially parallel to the first axis 40. The secondary cutting blades 90, 92 extend obliquely from the primary cutting blade 88.

Each cutting blade 32 includes a blade body 94 including a substantially triangular cross-sectional shape including a base 96 positioned adjacent to an outer surface of the bottom sidewall 44 and an apex 98 spaced from the base 96 along the second axis 50. The height 100 of the cutting blade 32 is defined between the base and the apex. In the illustrated embodiment, each cutting blade 32 includes the same height 100. In other embodiments, one or more cutting blades has a different height 100.

Each secondary cutting blade 90, 92 extends obliquely from the primary cutting blade 88 towards the rear sidewall 48 and includes a first end 102 positioned adjacent the primary cutting blade 88 and a second end 104 spaced a distance from the primary cutting blade 88 defined along the third axis 52. In the illustrated embodiment, each secondary cutting blade 90, 92 extends between the first end 102 positioned adjacent the primary cutting blade 88 and the second end 104 positioned adjacent the rear sidewall 48. In other embodiments, the second end 104 of one or more secondary blades is spaced a distance from the rear sidewall 48.

The cutting tool 20 includes a first secondary cutting blade 90 extending a first oblique angle 106 from the primary cutting blade 88, and a second secondary cutting blade 92 extending a second oblique angle 108 from the primary cutting blade 88. In the illustrated embodiment, the first oblique angle 106 is opposite the second oblique angle 108 such that the first and second secondary cutting blades 90, 92 extend from the primary cutting blade 88 in a mirrored relationship. In other embodiments, the first oblique angle 106 may be equal to or different from the second oblique angle 108, or the first and second secondary cutting blades 90, 92 may be orientated substantially parallel.

In the illustrated embodiment, the first and second secondary cutting blades 90, 92 are spaced along the first axis 40 such that a first gap 110 is formed having a first distance 112 defined between the first ends 102 of the first and second secondary cutting blades 90, 92 along the first axis 40, and a second gap 114 is formed having a second distance 116 defined between the second ends 104 of the first and second secondary cutting blades 90, 92 along the first axis, with the second gap 114 being larger than the first gap 110. In other embodiments, the first and second secondary cutting blades 90, 92 may be orientated such that the second gap 114 is smaller than the first gap 110. In some embodiments, the primary cutting blade 88 has a length 118 defined along the first axis 40 that is longer than the second gap 114 defined between the second ends 104 of the pair of secondary cutting blades 90, 92.

Figures 11A, 11B, 11C:
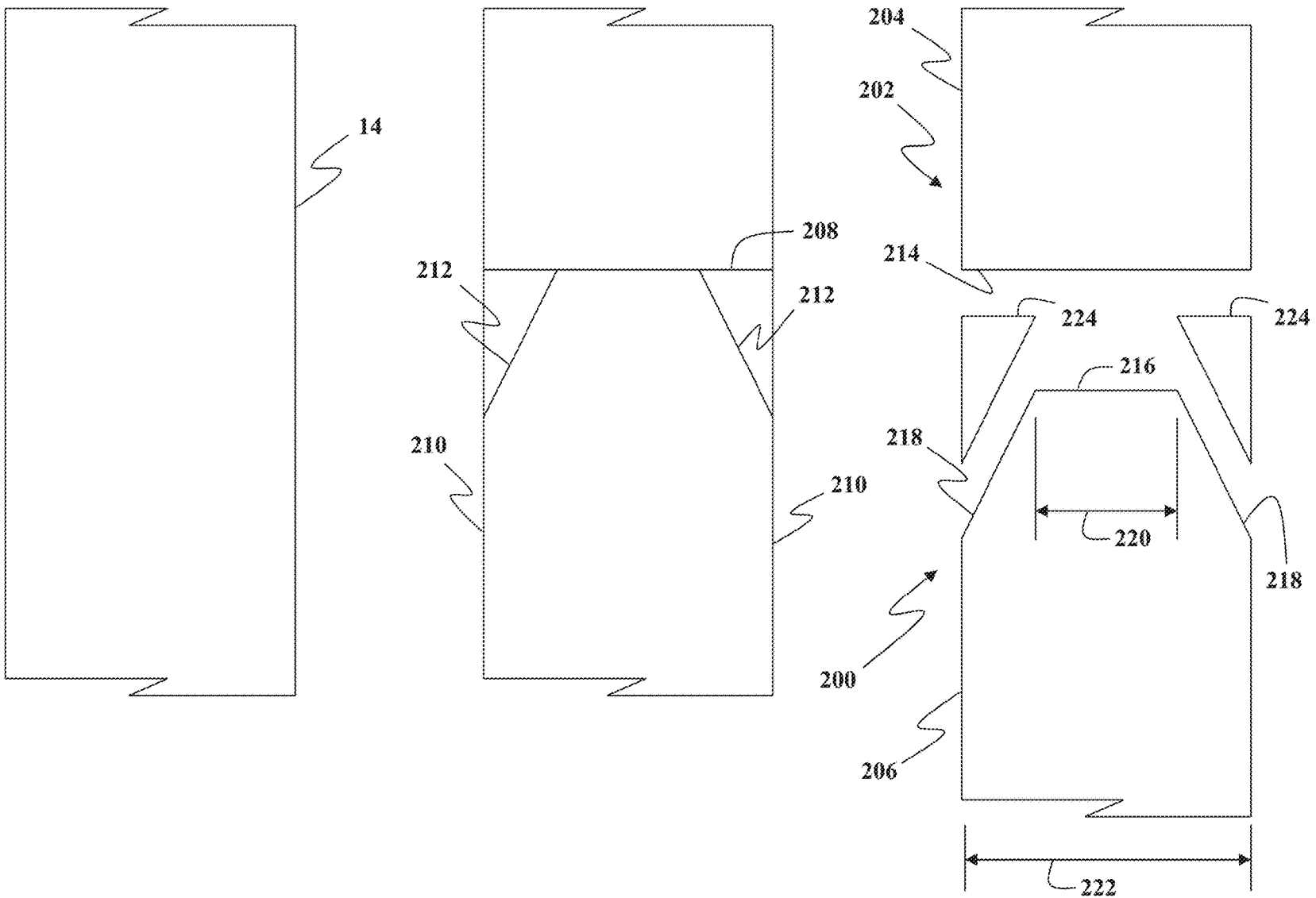
FIGS. 11A-11C illustrate the cutting lines formed on a roll of fabric by the cutting tool.
Figure 12:
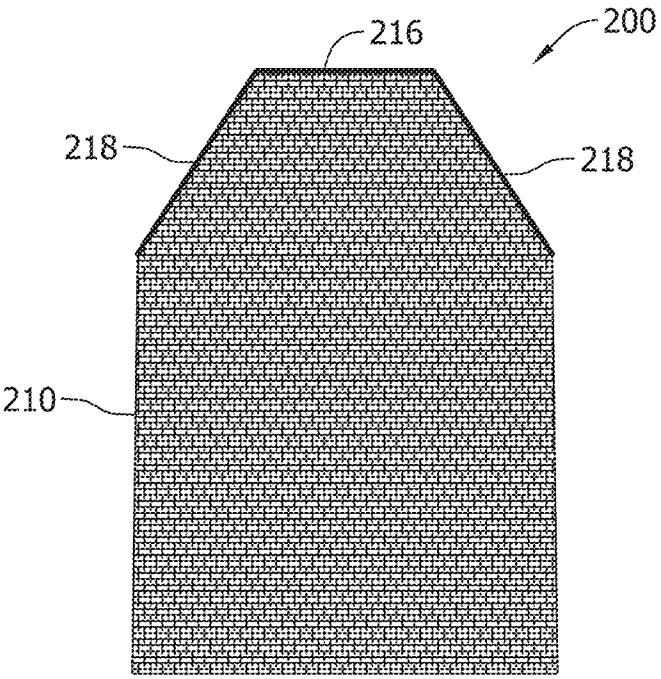
FIG. 12. illustrates an end of a fabric belt that is formed from a roll of fabric by the machine using the heated tool assembly.

Referring to FIGS. 11A-12, in some embodiments, the cutting tool 20 is used to cut a piece of woven fabric material 14 to form a front portion 200 and a rear portion 202 of fabric belts 204, 206. As the cutting tool 20 is pressed onto the woven fabric material 14, the primary cutting blade 88 makes straight cut line 208 along the woven fabric material 14 that is substantially perpendicular to the side edges 210 of the woven fabric material 14. The second secondary cutting blades 90, 92 form mirrored angled cut lines 212 that extend from the straight cut line 208 to the side edges 210 of the fabric material 14. The straight cut line 208 forms the rear portion 202 of a first fabric belt 204 having a rear edge 214 that is substantially perpendicular to the side edges 210. The straight cut line 208 also forms a front edge 216 of the front portion 200 of a second fabric belt 206 this is substantially perpendicular to the side edges 210. The mirrored angled cut lines 212 form opposing angled edges 218 of the front portion 200 of a second fabric belt 206, and form the front edge 216 with a length 220 that is less than the length 222 defined between the side edges 210. The straight cut line 208 and the mirrored angled cut lines 212 also form two right-triangles of remaining material 224 from the woven fabric material 14.

In various embodiments, the cutting tool 20 is designed to function as a highly-efficient heated knife blade made to cut 2" wide material. The blade cuts a proprietary shape and a straight cut simultaneously. The three evenly-spaced mounting holes which run through the Y plane of the part allow it to be mounted to an automatic cutting machine. The upper and lower holes running through the X plane of the part are designed to accept 12 mm and 14 mm heating rods respectively. The four threaded holes found at the corners of the front face of the part are to accommodate set screws used to hold the heating rods in place. The threaded hole found centered height-wise in the leftmost third of the front face is designed to accommodate a thermocouple used to regulate temperature. The heating rods (also referred to as cartridge or insertion heating elements) are a generic product produced by several different manufacturers. The primary material used in the heating rods is Incoloy 800. The cutting tool 20 is made from 4140 Steel, however there are many different types of metals which would be well-suited for the application.

The more heat provided to the blade, the more perfectly repeatable the cuts will be. The tip of the blade loses small amounts of heat during each cut when energy from the blade is drawn away by the material being cut, so the larger diameter heating rod helps minimize that effect by providing heat to bring the blade back up to temp quickly. The diameter of the heating rods isn't critical, and the rods don't have to be different sizes, but the combination of heating rods with the previously mentioned diameters creates an optimal balance between energy consumption and repeatable cut performance. Two heating rods are not required, however, any more or less would change the performance of the part. The combination used in the illustrated embodiment provides acceptable results.

In some embodiments, the support body 30 may include a width measured along the third axis 52 of about 1.181 inches and a length measure along the first axis 40 of about 4.734 inches. The length of the primary cutting blade 88 may be about 2.335 inches and the length of each secondary cutting blade 90, 92 measure between the first and second ends 102, 104 may be about 1.181 inches. The first and second oblique angles 106, 108 may each be about 63.4° , with the first gap 110 having a length of about 1 inch and the second gap 114 having a length of 2.056 inches. The above described measurements are for illustrative purposes only, and one skilled in the art would understand that other suitable length and angle measurements are contemplated and would fall within the scope of the present invention.

Obviously, many modifications and variations of the present invention are possible in light of the above teachings. The invention may be practiced otherwise than as specifically described within the scope of the appended claims.

Although specific features of various embodiments of the disclosure may be shown in some drawings and not in others, this is for convenience only. In accordance with the principles of the disclosure, any feature of a drawing or other embodiment may be referenced and/or claimed in combination with any feature of any other drawing or embodiment.

This written description uses examples to describe embodiments of the disclosure and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A cutting tool for use with a fabric cutting machine, comprising:

a support body including a substantially rectangular cross-sectional shape;

a plurality of cutting blades extending outwardly from a bottom surface of the support body, the plurality of cutting blades including:

a primary cutting blade and a pair of secondary cutting blades extending obliquely from the primary cutting blade in a mirrored relationship;

a plurality of heating element chambers defined within the support body, each of the heating element chambers configured to receive a heating cartridge therein to facilitate transferring thermal energy from the heating cartridge to the cutting tool for use in heating the plurality of cutting blades, the plurality of heating element chambers including a first heating element chamber having a first diameter sized to receive a 14 mm heating cartridge therein and a second heating element chamber having a second diameter sized to receive a 12 mm heating cartridge therein, the first heating element chamber positioned closer to the plurality of cutting blades than the second heating element chamber; and a thermocouple opening oriented between the first heating element chamber and the second heating element chamber and configured to receive a thermocouple therein.

2. The cutting tool of claim 1, wherein the support body includes a plurality of sidewalls extending between a first endwall and an opposite second endwall along a first axis, the plurality of sidewalls including a top sidewall, a bottom sidewall defining the bottom surface, a front sidewall, and a rear sidewall, the bottom sidewall spaced a distance from the top sidewall along a second axis that is perpendicular to the first axis, the rear sidewall spaced a distance from the front sidewall along a third axis that is perpendicular to the first axis and the second axis.

3. The cutting tool of claim 2, wherein the primary cutting blade is positioned adjacent to the front sidewall and oriented substantially parallel to the first axis.

4. The cutting tool of claim 3, wherein the pair of secondary cutting blades extend from the primary cutting blade towards the rear sidewall.

5. The cutting tool of claim 3, wherein each secondary cutting blade of the pair of secondary cutting blades extends between a first end positioned adjacent the primary cutting blade and a second end positioned adjacent the rear sidewall.

6. The cutting tool of claim 2, wherein each heating element chamber is orientated substantially parallel to the first axis and includes an inner surface that defines a substantially cylindrical cavity extending between a first open end defined at the first endwall and an opposite second open end defined at the second endwall.

7. The cutting tool of claim 6, wherein each heating element chamber is spaced an equal distance between the front sidewall and the rear sidewall.

8. The cutting tool of claim 6, wherein the support body includes a pair of set screw openings associated with each heating element chamber defined along the rear sidewall and configured to receive set screws therein to facilitate coupling the heating cartridge to the support body.

9. The cutting tool of claim 6, wherein the thermocouple opening is defined along an outer surface of the rear sidewall.

10. The cutting tool of claim 1, wherein each heating cartridge includes Incoloy.

11. The cutting tool of claim 1, wherein the support body includes a plurality of mounting chambers configured to receive mounting fasteners therein to facilitate coupling the support body to the fabric cutting machine.

12. The cutting tool of claim 1, wherein the support body and the plurality of cutting blades are formed as a unitary body.

13. The cutting tool of claim 1, wherein the support body includes 4140 steel.

14. A tool assembly, comprising:

a cutting tool including:

a support body including a substantially rectangular cross-sectional shape;

a plurality of cutting blades extending outwardly from a bottom surface of the support body, the plurality of cutting blades including:

a plurality of heating element chambers defined within the support body, each of the heating element chambers configured to receive a heating cartridge therein to facilitate transferring thermal energy from the heating cartridge to the cutting tool for use in heating the plurality of cutting blades, the plurality of heating element chambers including a first heating element chamber having a first diameter and a second heating element chamber having a second diameter that is smaller than the first diameter, the first heating element chamber positioned closer to the plurality of cutting blades than the second heating element chamber; and a heating assembly coupled to the cutting tool for transferring thermal energy to the cutting tool for use in heating the plurality of cutting blades, the heating assembly including a 14 mm heating cartridge positioned within the first heating element chamber and a 12 mm heating cartridge positioned within the second heating element chamber; and a thermocouple positioned within a thermocouple opening oriented between the first heating element chamber and the second heating element chamber.

15. The tool assembly of claim 14, wherein the support body includes a plurality of sidewalls extending between a first endwall and an opposite second endwall along a first axis, the plurality of sidewalls including a top sidewall, a bottom sidewall defining the bottom surface, a front sidewall, and a rear sidewall, the bottom sidewall spaced a distance from the top sidewall along a second axis that is perpendicular to the first axis, the rear sidewall spaced a distance from the front sidewall along a third axis that is perpendicular to the first axis and the second axis.

16. The tool assembly of claim 15, wherein the primary cutting blade is positioned adjacent to the front sidewall and oriented substantially parallel to the first axis.

17. The tool assembly of claim 16, wherein the pair of secondary cutting blades extend from the primary cutting blade towards the rear sidewall.

18. The tool assembly of claim 16, wherein each secondary cutting blade of the pair of secondary cutting blades extends between a first end positioned adjacent the primary cutting blade and a second end positioned adjacent the rear sidewall.

19. The tool assembly of claim 15, wherein the thermocouple opening is defined along an outer surface of the rear sidewall.

20. The tool assembly of claim 14, wherein each heating cartridge includes Incoloy.

* * * * *